United States Patent [19]

Oliff

[11] 4,374,562

[45] Feb. 22, 1983

[54] ARTICLE CARRIER

[75] Inventor: James R. Oliff, Austell, Ga.

[73] Assignee: The Mead Corporation, Dayton, Ohio

[21] Appl. No.: 236,744

[22] Filed: Feb. 23, 1981

[51] Int. Cl.[3] ..... B65D 65/12; B65D 85/30

[52] U.S. Cl. ..... 206/434; 229/40; 229/89

[58] Field of Search ..... 206/429, 434, 427; 229/40, 28 BC, 89

[56] References Cited

U.S. PATENT DOCUMENTS

| | | | |
|---|---|---|---|
| 4,029,204 | 6/1977 | Manizza | 206/434 |
| 4,243,143 | 1/1981 | Muller | 206/429 |

FOREIGN PATENT DOCUMENTS

| | | | |
|---|---|---|---|
| 1007201 | 6/1970 | Canada | 206/434 |
| 963434 | 2/1975 | Canada | 206/434 |
| 1564751 | 3/1969 | France | 206/434 |
| 7622038 | 7/1976 | France | 206/434 |

*Primary Examiner*—Joseph Man-Fu Moy

*Attorney, Agent, or Firm*—Rodgers & Rodgers

[57] ABSTRACT

A wraparound type article carrier having parallel top and bottom panels, parallel side panels, the side panels being joined to the bottom panel by means of sloping panels, multiple heel receiving apertures formed in the sloping panels, a retention tab joined to one of the sloping panels around the periphery of a heel receiving aperture, and the retention tab being joined to the sloping panel by means of spaced connecting elements.

5 Claims, 2 Drawing Figures

ARTICLE CARRIER

TECHNICAL FIELD

This invention relates to the wraparound variety of article carriers and is especially adapted to the packaging of articles having irregularly configured heel portions.

BACKGROUND ART

In general the lower portions of packaged articles are held in place in a wraparound carrier by means of apertures formed along the lower portions of the carrier. Since most article heels have historically been of rounded configurations, the heel portions readily fit snugly in conventional heel receiving apertures. Examples of various conventional structures are disclosed in U.S. Pat. Nos. 3,163,321, 3,249,254, 3,263,893, 3,278,075, 3,384,291 and 3,495,704. More recently article bottom structures are formed of varying shapes and profiles including star, petaloidal, champagne, and scalloped configurations. Of course normally a carrier heel receiving aperture would have to be especially adapted to conform to each special article heel shape. This naturally adds greatly to the manufacturing cost of the carriers.

DISCLOSURE OF THE INVENTION

According to this invention an article carrier is provided and comprises top, bottom and side panels, the side panels being interconnected to the bottom panel by means of sloping panels, a heel receiving aperture formed substantially in one of the sloping panels, and a retention tab foldably joined along the periphery of the heel receiving aperture to the sloping panel by means of a pair of spaced connecting elements.

BEST MODE FOR CARRYING OUT THE INVENTION

Figure 1:
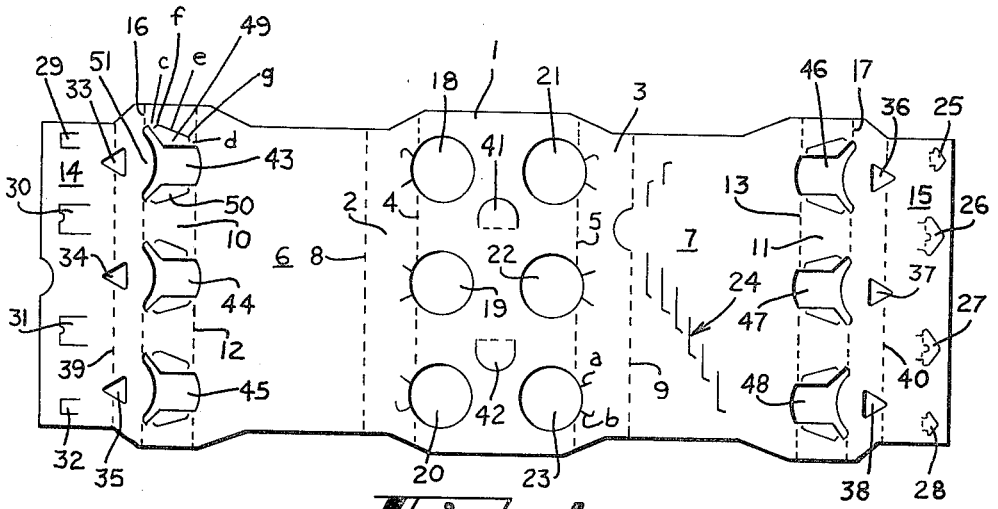
FIG. 1 is a plan view of the blank from which the article carrier is formed according to this invention and FIG. 2 is a perspective view of a fully erected carrier with the articles disposed therein.

In the drawing and with particular reference to FIG. 1, the numeral 1 designates the top panel of the carrier to the side edges of which sloping panels 2 and 3 are joined respectively along fold lines 4 and 5. Similarly side panels 6 and 7 are foldably joined to the lower edges of sloping panels 2 and 3 respectively along fold lines 8 and 9.

Sloping panels 10 and 11 are joined to the lower edges of side panels 6 and 7 respectively along fold lines 12 and 13. To complete the basic elements of the carrier, the bottom panel is of a composite construction and includes bottom panels 14 and 15 which are joined respectively to the lower edges of sloping panels 10 and 11 along fold lines 16 and 17.

Neck receiving apertures 18, 19, 20, 21, 22 and 23 are formed in top panel 1 and each neck receiving aperture is provided with expansion slits a and b. In addition carrier opening means is formed in side panel 7 as indicated generally by the numeral 24.

Carrier locking means is provided in the form of locking tabs 25, 26, 27 and 28 formed in bottom panel 15 and which cooperate in known manner with locking apertures formed in bottom panel 14 as indicated by the numerals 29, 30, 31 and 32. In addition machine tightening apertures 33, 34 and 35 are formed in bottom panel 14 and, likewise, machine tightening apertures 36, 37 and 38 are formed in bottom panel 15. Also blank manipulation fold lines 39 and 40 are formed respectively in bottom panels 14 and 15. In order to facilitate transport of the carrier, finger gripping apertures 41 and 42 are formed in top panel 1.

In order to aid in holding the lower portions of the articles in place, heel receiving apertures 43, 44, and 45 are formed in sloping panel 10 and, in similar fashion, heel receiving apertures 46, 47 and 48 are formed in sloping panel 11. Since the basic elements of each heel receiving aperture are essentially identical, only aperture 43 will be discussed in detail.

According to a feature of this invention, retention tabs 49 and 50 are formed on the periphery of heel receiving aperture 43. Each retention tab 49 and 50 is connected to sloping panel 10 by means of spaced connecting elements c and d. As is apparent in FIG. 1, the pairs of connecting elements c and d are spaced apart by means of expansion slit e. Further each expansion slit e has curved ends f and g which are generally curved toward heel receiving aperture 43. Also formed on the periphery of heel receiving aperture 43 and disposed generally intermediate retention tabs 49 and 50 is cushioning flap 51.

In order to form the carrier from the blank shown in FIG. 1, it is simply necessary to envelope the blank about a group of six articles whereby the necks of the articles are projected respectively through neck receiving apertures 18–23. Then the blank is simply tightened around the group of articles by cooperation between apertures 33–38 and appropriate machine elements. Following this locking tabs 25–28 are inserted into a locking relationship respectively with locking apertures 29–32. The carrier then appears as shown in FIG. 2.

Figure 2:
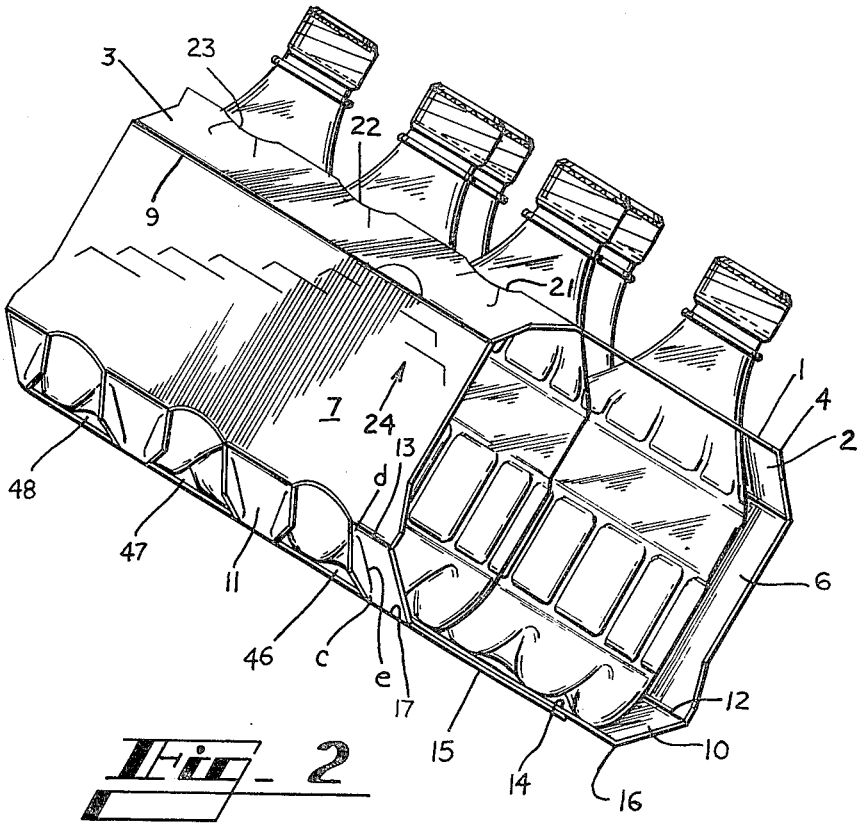

As illustrated in FIG. 2, the article heel structures are of a scalloped or irregular configuration and since each article is packaged at a random orientation with respect to the carrier, the exact shape of the portion of the article heels which project into the respective heel receiving apertures will be of varying profiles. More specifically the projecting portion of a particular article heel might enter the respective heel receiving aperture or, likewise, an indented portion of the article might be caused to enter the aperture. For this reason and according to this invention, retention tabs such as 49 and 50 provide a tension force to the article heels no matter what portion of the heel is disposed in the heel receiving aperture. This tension force is achieved by the cooperation between connecting elements c and d and curved ends f and g of expansion slit e. Therefore any degree of displacement of the retention tab out of the plane of the associated sloping panel causes a tension force on the abutting portion of the article and thereby causes the article to be retained in its proper position and prevents it from rotating out of position.

INDUSTRIAL APPLICABILITY

By this invention an article carrier is provided which is economical to manufacture and is adaptable to the packaging of articles having a wide variety of heel configurations.

I claim:

1. An article carrier comprising parallel top and bottom panels, parallel side panels, said side panels being interconnected respectively to the side edges of said bottom panel by a pair of sloping panels, a heel receiving aperture formed substantially in one of said sloping panels, a retention tab foldably joined to said one sloping panel, said retention tab being joined along the periphery of said heel receiving aperture by means of spaced connecting elements, said connecting elements being separated by an expansion slit, and both ends of said expansion slit being curved generally toward said heel receiving aperture.

2. An article carrier according to claim 1 wherein multiple articles are disposed in said carrier and wherein the heels of said articles are of irregular configurations and wherein one of said articles is disposed in said heel receiving aperture and in abutment with said retention tab.

3. An article carrier according to claim 2 wherein said heel is generally of a scalloped configuration.

4. An article carrier according to claim 1 wherein a cushioning flap is formed on the periphery of said heel receiving aperture and is disposed generally adjacent said retention tab.

5. An article carrier blank comprising a top panel, a pair of side panels joined respectively to the side edges of said top panel, a pair of sloping panels joined respectively to said side panels remote from said top panel, a heel receiving aperture formed substantially in one of said sloping panels, a retention tab joined to said one sloping panel along the periphery of said heel receiving aperture by means of a pair of spaced connecting elements, said connecting elements being separated by an expansion slit and both ends of said expansion slit being curved generally toward said heel receiving aperture.

* * * * *